US005479791A

United States Patent [19]

Osborne

[11] Patent Number: 5,479,791

[45] Date of Patent: Jan. 2, 1996

[54] BRASSIERE BLANK, BRASSIERE AND METHODS OF MAKING SAME

[75] Inventor: Harold G. Osborne, Boomer, N.C.

[73] Assignee: Alba-Waldensian, Inc., Valdese, N.C.

[21] Appl. No.: 237,114

[22] Filed: May 3, 1994

[51] Int. Cl.[6] ..... A41C 3/00; A41D 27/00

[52] U.S. Cl. ..... 66/171; 66/169 R; 66/172 R; 66/172 E; 2/73; 450/70; 450/92

[58] Field of Search ..... 2/73, 400, 401, 2/402, 403, 404, 405, 406, 407, 408; 66/169 R, 170, 171, 172 R, 172 E, 175, 176, 177, 199; 450/1, 80, 70, 79, 92

[56] References Cited

U.S. PATENT DOCUMENTS

| | | | |
|---|---|---|---|
| 993,112 | 5/1911 | Scott | 66/199 |
| 993,799 | 5/1911 | Scott | 66/199 |
| 2,293,639 | 8/1942 | Coleman | 66/199 |
| 3,224,231 | 12/1965 | Matz | 66/199 |
| 3,376,717 | 4/1968 | Scheller et al. | 66/199 |
| 3,421,513 | 1/1969 | Landau | 66/176 |
| 3,425,246 | 2/1969 | Knohl | 66/176 |
| 3,537,279 | 11/1970 | Epley | 66/176 |
| 3,999,406 | 12/1976 | Boeckle et al. | 66/177 |
| 4,341,219 | 7/1982 | Kuznetz . | |
| 4,531,525 | 7/1985 | Richards . | |
| 4,548,057 | 10/1985 | Essig | 66/172 R |
| 4,624,115 | 11/1986 | Safrit et al. . | |
| 4,682,479 | 7/1987 | Pernick . | |
| 5,081,854 | 1/1992 | Lonati . | |

FOREIGN PATENT DOCUMENTS

| | | | |
|---|---|---|---|
| 0387766 | 9/1990 | European Pat. Off. | 66/176 |
| 2220150 | 9/1974 | France | 450/1 |

*Primary Examiner*—Jeanette E. Chapman
*Attorney, Agent, or Firm*—Bell, Seltzer, Park & Gibson

[57] ABSTRACT

This invention discloses methods of manufacturing brassiere blanks and brassieres, and the brassieres made therefrom. In particular, the methods and brassieres involve circular knitting operations in which a brassiere blank is produced on a circular knitting machine as a cylindrical tube, and thereafter cut and sewn only at the shoulders to produce a brassiere having shoulder straps knit integrally with a front torso portion having a pair of breast cups and a rear torso portion cooperating with the front torso portion in forming a torso encircling portion.

8 Claims, 1 Drawing Sheet

BRASSIERE BLANK, BRASSIERE AND METHODS OF MAKING SAME

BACKGROUND OF THE INVENTION (1) Field of the Invention

The present invention relates to a brassiere, the blank for making the brassiere and to the methods for making the brassiere and the blank. More particularly, this invention relates to producing a brassiere blank on a circular knitting machine, producing a brassiere from the blank having seams only at the shoulder straps.

(2) Description of the Prior Art

Brassieres having fabric areas to define breast cups have been produced by full fashioned and reciprocating knitting machines, but blank and brassiere production is slow and inefficient unless circular knitting is used. One such improved circular knitting process is disclosed in Richards U.S. Pat. No. 4,531,525 wherein a brassiere blank is made on a circular knitting machine which includes producing a cylindrical tubular blank having a torso portion with a pair of breast cups and straps knit integrally with the torso portion and having turned welt portions at each end of the cylindrical blank. The tubular blank is slit on one side, laid flat for cutting neck and arm openings and seaming at each side to form the brassiere.

SUMMARY OF THE INVENTION

It an object of this invention to provide a circular knit, cylindrical tube blank from which a brassiere may be made.

Another object of this invention is to provide a method for manufacturing a brassiere blank which has a fabric construction shaped to contours desired for the finished brassiere so as to minimize the manufacturing steps required for completion of the brassiere.

A further object of this invention is to provide a method of manufacturing a brassiere from a single circular knit, cylindrical tubular blank to produce a brassiere having a torso engaging portion and straps integrally knit with the torso portion.

Yet another object of this invention is to provide a brassiere fabricated from circular knit fabric and in which differential stitch structures in coursewise directions accomplish the principle shaping of the finished brassiere.

An even further object of this invention is to provide a brassiere from a single piece of circular knit fabric having sewn only at the shoulder strap seams and the banding.

In accordance with the present invention there is described a method of manufacturing a circular knit blank which includes knitting a series of courses defining a cylindrical tubular fabric torso encircling portion which includes a first or lower torso portion in the form of a turned welt. The torso encircling portion also includes a second or upper torso portion comprising a series of courses defining a cylindrical tubular fabric portion having a pair of breast cups on the front of the upper torso portion defined by two areas in which the fabric is in simple knit courses with the areas being separated one from another, the courses defining the front torso portion differentially shaping the breast cups. A rear torso portion knit to the rear portion of the turned welt and in which the fabric is in simple knit coursed. The first several courses of the upper torso portion provide a series of tucks around the torso portion, immediately above the turned welt portion. To the upper torso portion, a shoulder portion having a cylindrical tubular front and back fabric straps are knit. Each strap forms an elongated area in which the courses are simple knit with the areas being divided by an elongated panel area in which succeeding courses are also simple knit. Lastly, the circular knit tubular blank is completed by knitting several courses forming a non-raveling edge.

In a preferred embodiment of the circular knit blank of this invention, the breast cups are separated one from the another by a central area of gathered panels in which succeeding courses vary between simple knit and welt knit courses.

The brassiere of the present invention is made from a circular knit tubular blank by cutting the fabric of the blank along the neck lines and arm hole lines. The waste fabric is removed to define pairs of front and rear shoulder straps. Banding and the like are added to finish off the brassiere. Lastly, the shoulder straps are sewn together. There is thus provided a brassiere made from a blank of knit construction which is shaped to the contours of a finished brassiere, thereby minimizing the steps of completing the finished brassiere.

Other objects, features and advantages of the present invention will become apparent from the following detailed description when taken in conjunction with the accompanying drawings.

DESCRIPTION OF THE PREFERRED EMBODIMENTS

Figure 1:
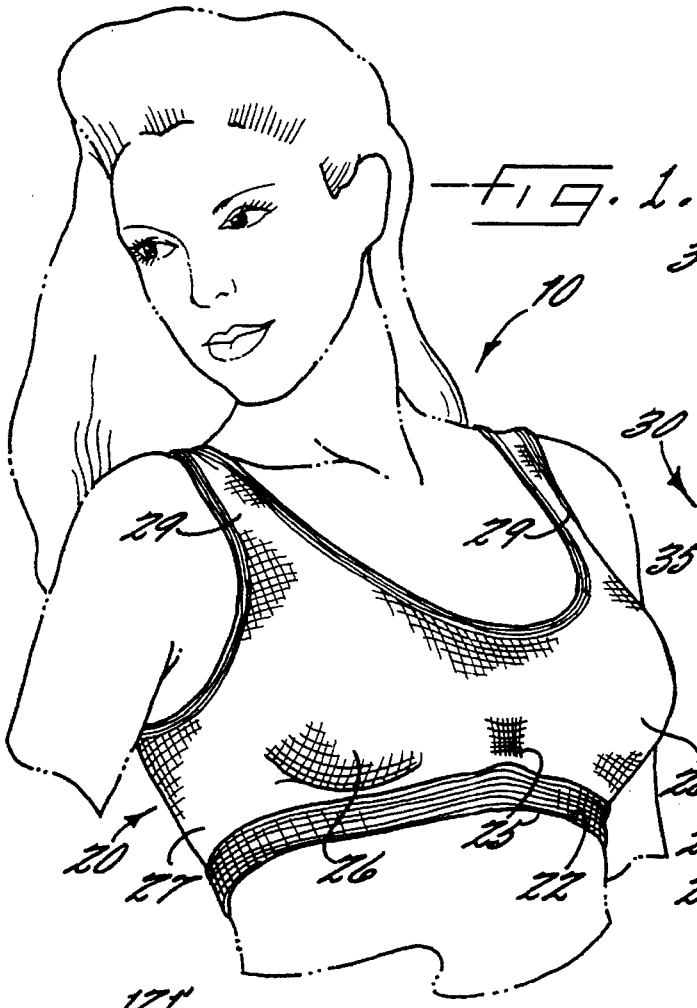
FIG. 1 is a perspective view illustrating an embodiment of a brassiere in the present invention made from the blank shown in FIG. 2 as it is worn.

Referring now to the drawings, FIG. 1 shows a preferred embodiment of the finished brassiere of the present invention represented generally at 10. The brassiere 10 includes a cylindrical tubular torso encircling portion 20 including a first or lower portion in the form of a turned welt portion 22 and an upper torso portion comprising a series of courses defining a cylindrical tubular fabric portion defining a front torso portion 27 and a rear torso portion 28 knit to the turned welt portion 22. The front torso portion 27 has a pair of breast cups 26 defined by areas in which the courses are simple knit and have succeeding courses varying between simple knit and welt knit courses. Following the turned welt portion 22, the first several courses of the front torso portion 27 and rear torso portion 28 include a series of tucks gathering the upper torso portion to the turned welt, shown in FIG. 2. The courses defining the front torso portion 27 differentially shape the breast cups 26. The torso portion includes a rear portion above the turned welt and in which the fabric is in simple knit courses. A pair of front shoulder straps 29 are each knit to the front torso portion and a pair of back shoulder straps are each knit to the rear torso portion and in which the fabric is in simple knit courses with patterns. The back shoulder straps are like the back straps 131 shown in the embodiment of FIG. 4.

Figure 2:
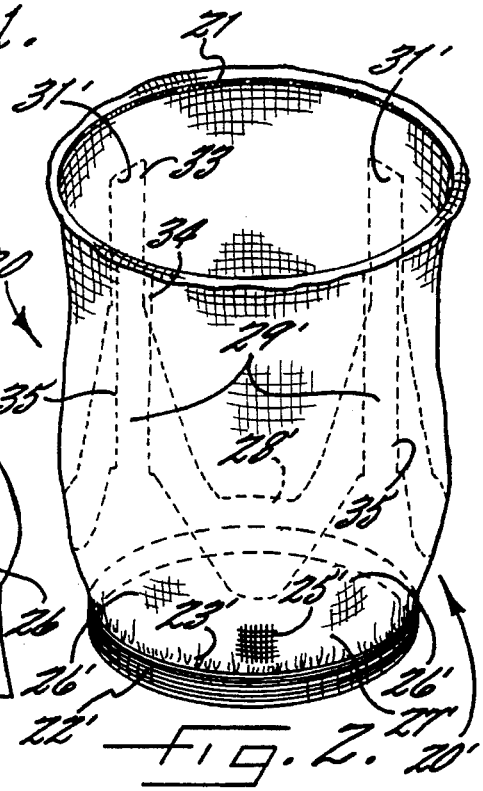
FIG. 2 is a front elevation view of an embodiment of a circular knit cylindrical blank in accordance with the present invention and from which the brassiere of FIG. 1 is manufactured.

In a preferred embodiment of this invention, the breast cups 26 are defined by areas in which the courses are simple knit with the breast cup areas 26 being separated by a center gathered panel area 25 shown in FIGS. 1 and 2, in which the courses varying between simple and welt knit courses. The gathered portion 25 is made by pulling the cams away from the butts allowing the shorter button needles to pass through underneath the cams to hold the stitch for a predetermined number of courses, say 3 to 20 and preferably 10 to 12, then the needles are raised to clear the stitch to form a pleat, then the process is repeated until the gather is formed. The cams are then returned to the cylinder so that the button needles will rise.

Turning now to FIG. 2, there is shown a brassiere blank 30, made on a high speed circular knitting machine, from which the brassiere 10 is produced. The blank 30 is a cylindrical tube having portions which correspond to the portions of the brassiere described in FIG. 1. The reference characters corresponding to those used with reference to FIG. 1 will be applied in FIG. 2, with the addition of prime notation. Thus, the torso portion 20', in the blank 30, includes a turned welt portion 22' as is produced on circular knitting machines in well known ways and the upper torso portion comprising front portion 27' and rear portion 28'. The differentially shaped breast cups 26' are defined on the front panel of the torso portion 20'. The straps 29', 31' are shown on the knitted portion above the torso portion. A non-raveling edge 21' formed of several courses tops off the brassiere blank 30. Tucks 23' are formed in the upper torso portion immediately above the turned welt portion 22', in a manner known to those skilled in the knitting art.

The various portions of the circular knit tubular brassiere blank 30 are integrally knit together and have stitch constructions as described hereinabove. Thus, the method of manufacturing the blank will become more clearly understandable and may be characterized as knitting a series of courses defining a first cylindrical tubular portion in the form of a turned welt 22', and then knitting to the first turned welt portion a series of courses defining a cylindrical upper tubular torso portion 20' having a series of tucks 23' where the courses start immediately above the turned welt 22'. The front torso portion 27' has a pair of breast cups 26' defined by two areas in which the courses are simple knit with the areas being separated one from the other by areas of gathered panels 25' in which succeeding courses vary between simple knit and welt knit courses, the knitting of courses defining the front torso portion differentially shaping the breast cups with respect to the gathered panels. As will be understood, the degree of shaping will vary, and may be taken into account in accomplishing sizing of the brassiere. Then knitting to the front torso portion a series of courses defining a cylindrical tubular fabric shoulder strap 29' and rear torso portion having an elongated shoulder strap areas 31' in which the courses are simple knit, and the knitting to the upper portion several courses forming a non-raveling edge 21'.

In manufacturing the brassiere 10 from the blank 30 the fabric of the blank 30 as shown in FIG. 2 is cut along a pair of neck lines 33, and a pair of arm hole lines 35 and waste fabric is removed so as to define the front shoulder straps 29' and the rear shoulder straps 31' which are sewn together along a seam (not shown). Banding and the like may be added to finish off the brassiere. The brassiere is of a circular knit construction, with the turned welts 22 extending in a coursewise direction. The first several courses of the upper torso portion are knit so as to provide a series of tucks, shown at 23' in FIG. 2, around the upper torso portion 20, immediately above the turned welt portion 22'. When the brassiere is worn, as shown in FIG. 1, the knit fabric fits snugly to the body and the tucks are not evident. Thus, the fabric construction is the upper torso portion is such that the coursewise direction of the knit fabric is generally circumferential of the body of the wearer of the brassiere 10. The courses are knit in such a way as to shape the breast cup 26. In particular, the fabric in the breast cups are a simple knit, while the area between the cups 26 in the embodiment of FIG. 1 are formed by gathered fabric having successive courses varying between simple knit and welt knit stitches.

Simple knit stitches used to distinguish those stitch constructions possible on a circular knitting machine and in which yarn is taken into a needle during each rotation of the cylinder, such as plain, purl, tuck and combinations thereof. Reference to welt knit is intended to encompass miss-stitch or float stitch constructions in which loops in certain courses are held without additional yarns being taken and then knit into subsequent courses, thereby gathering the courses together and providing the characteristic turned welt or panel effect referred to above.

Figure 3:
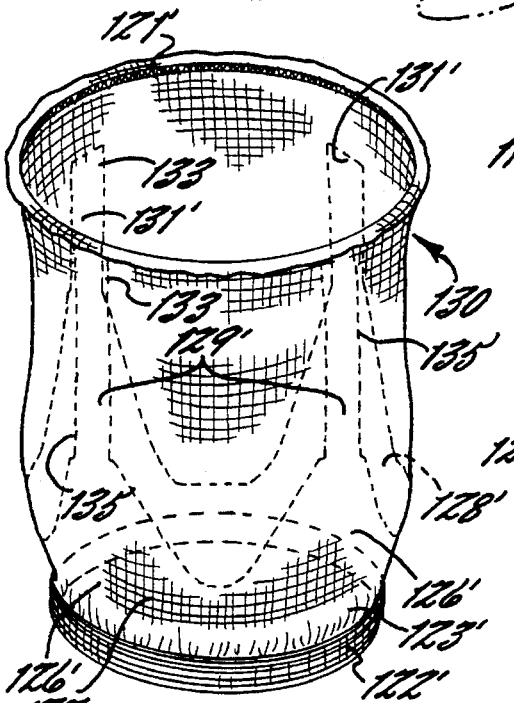
FIG. 3 is a front elevation view of another embodiment of a circular knit cylindrical blank in accordance with the present invention and from which the brassiere of FIG. 4 is manufactured.

In another embodiment, that shown in FIG. 3, a blank 130 is made similarly to the blank 30 in FIG. 2, but without the central gathered portion 25'. A cylindrical tubular fabric torso encircling portion 120' is knit in the form of a turned welt portion 122' and an upper torso portion comprising a front torso portion 127' and a rear torso portion 128'. The front torso portion 127' comprises a series of courses defining a cylindrical tubular fabric portion having a pair of breast cups 126' on the front portion defined by areas in which the courses are simple knit and having succeeding courses varying between simple knit and welt knit courses. The first several courses of the upper torso portion are knit so as to provide a series of tucks 123' around the upper torso portion immediately above the turned welt portion 122'. Then knitting to the torso portion a shoulder portion having a cylindrical tubular front and back fabric straps 129', 131' each having an elongated patterned area in which the courses are simple knit with the areas being divided by an elongated panel area in which succeeding courses vary between simple knit and welt knit courses. The blank 130 is completed by knitting several courses 121' forming a non-raveling edge.

Figure 4:
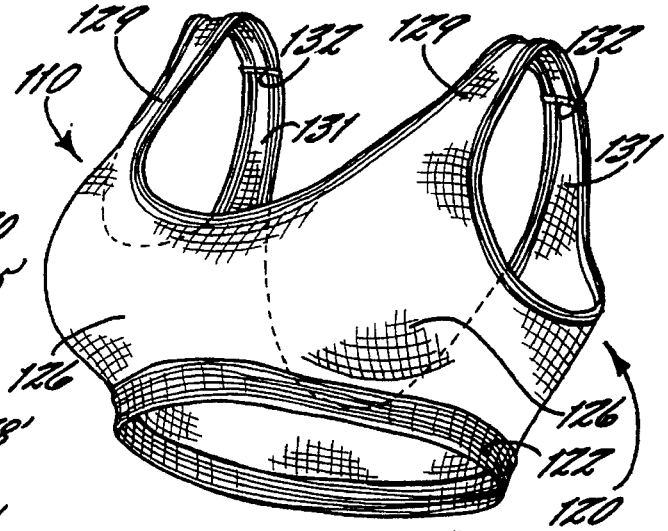
FIG. 4 is a perspective view of a brassiere made from the circular knit blank of FIG. 3 and illustrating another embodiment of the present invention.

The brassiere 110, shown is FIG. 4, is made from blank 130, shown in FIG. 3 by cutting along a pair of neck lines 133, and a pair of arm hole lines 135. The waste fabric is removed so as to define the front shoulder straps 129' and the rear shoulder straps 131' which are sewn together along seam 132. Banding and the like may be added to finish off the brassiere.

In the drawings and specification there has been set forth a preferred embodiment of the invention, and although specific terms are employed, they are used in a generic and descriptive sense only and not for purposes of limitation, the scope of the invention being defined in the claims.

What is claimed is:

1. A method of making a circular knit blank for the manufacture of a brassiere comprising:

knitting a series of courses defining the lower part of a cylindrical tubular fabric torso encircling portion in the form of a turned welt; and then knitting to said turned welt portion a series of courses defining a cylindrical tubular fabric upper portion having a front torso portion and a rear torso portionof said front torso portion having a pair of differentially shaped breast cups with respect to the remainder of the upper torso portion defined by areas in which the courses are simple knit courses; and then knitting to said upper torso portion a series of courses defining a shoulder portion having a cylindrical tubular front and back fabric straps each having an elongated area in which the courses are simple knit with the areas being divided by an elongated panel area, and then completing said blank by knitting several courses forming a non-welted non-raveling edge.

2. A method of making a circular knit blank for the manufacture of a brassiere comprising:

knitting a series of courses defining the lower part of a cylindrical tubular fabric torso encircling portion in the form of a turned welt; and then knitting to said turned welt portion a series of courses defining a cylindrical tubular fabric upper portion having a front torso portion and a rear torso portion, said front torso portion having a pair of differentially shaped breast cups with respect to the remainder of the upper torso portion defined by areas in which the courses are simple knit courses, and providing a series of tucks gathering said upper torso portion to said turned welt portion; and then knitting to said upper torso portion a series of courses defining a shoulder portion having a cylindrical tubular front and back fabric straps each having an elongated area in which the courses are simple knit with the areas being divided by an elongated panel area, and then completing said blank by knitting several courses forming a non-welted non-raveling edge.

3. The method of making a circular knit blank for the manufacture of a brassiere according to claim 2 wherein said series of courses defining said cylindrical tubular upper fabric portion having a pair of breast cups on the front portion of said torso portion defined by areas in which the courses are simple knit, further comprising, knitting an area between the breast cups separating the cups one from the other by a gathered panel in which succeeding courses vary between simple knit and welt knit courses.

4. The method of making a circular knit blank for the manufacture of a brassiere according to claim 1 wherein said series of courses defining said upper cylindrical tubular fabric portion having a pair of breast cups on the front portion of said torso portion defined by areas in which the courses are simple knit further comprising knitting an area between the breast cups separating the cups one from another by a gathered panel in which succeeding courses vary between simple knit and welt knit courses.

5. A circular knit blank for the manufacture of a brassiere comprising:

a cylindrical tubular fabric portion in the form of a turned welt;

a torso portion comprising a series of courses defining a cylindrical tubular fabric portion having a pair of breast cups on the frontal portion of said torso portion defined by areas in which the courses are simple knit;

a shoulder portion having a cylindrical tubular front and back fabric straps each having an elongated area in which the courses are simple knit with the areas being divided by an elongated panel area; and several courses forming a non-welted non-raveling edge.

6. A circular knit blank for the manufacture of a brassiere comprising:

a cylindrical tubular fabric portion in the form of a turned welt;

a torso portion comprising a series of courses defining a cylindrical tubular fabric portion having a series of tucks gathering said torso portion to said turned welt portion and a pair of breast cups on the frontal portion of said torso portion defined by areas in which the courses are simple knit;

a shoulder portion having a cylindrical tubular front and back fabric straps each having an elongated area in which the courses are simple knit with the areas being divided by an elongated panel area; and several courses forming a non-welted non-raveling edge.

7. The circular knit blank for the manufacture of a brassiere according to claim 6 further comprising said series of courses defining said upper cylindrical tubular fabric portion having a pair of breast cups on the front portion of said torso portion defined by areas in which the courses are simple knit, further comprising, the area between the breast cups being separated one from the other by areas of gathered panels in which succeeding courses vary between simple knit and welt knit courses.

8. The circular knit blank for the manufacture of a brassiere according to claim 5 further comprising said series of courses defining said upper cylindrical tubular fabric portion having a pair of breast cups on the front portion of said torso portion defined by areas in which the courses are simple knit further comprising the area between the breast cups being separated one from the another by areas of gathered panels in which succeeding courses vary between simple knit and welt knit courses.

* * * * *

UNITED STATES PATENT AND TRADEMARK OFFICE

CERTIFICATE OF CORRECTION

PATENT NO. : 5,479,791

DATED : January 2, 1996

INVENTOR(S) : Harold G. Osborne

It is certified that error appears in the above-indentified patent and that said Letters Patent is hereby corrected as shown below:

Col. 1, line 46, "principle" should be -- principal --.

Col. 1, line 63, "coursed" should be -- courses --.

Col. 3, line 9, "varying" should be -- vary --.

Col. 3, line 57 delete "an".

Col. 4, line 8, delete "is" first occurrence and insert -- in -- therefor.

Col. 4, line 16, insert -- are -- after "stitches".

Col. 4, line 67, "portion of" should be -- portion --.

Col. 4, line 67, before "said" insert a comma (,).

Col. 6, line 47, omit "the".

Signed and Sealed this

Ninth Day of July, 1996

*Attest:*

*Attesting Officer*

Bruce Lehman

BRUCE LEHMAN

*Commissioner of Patents and Trademarks*